United States Patent [19]

Theurer

[11] 4,221,169

[45] Sep. 9, 1980

[54] TRACK TAMPER

[75] Inventor: Josef Theurer, Vienna, Austria

[73] Assignee: Franz Plasser Bahnbaumaschinen-Industriegesellschaft m.b.H., Vienna, Austria

[21] Appl. No.: 974,093

[22] Filed: Dec. 28, 1978

[30] Foreign Application Priority Data

Jan. 23, 1978 [AT] Austria ..... 477/78

[51] Int. Cl.[2] ..... E01B 27/16

[52] U.S. Cl. ..... 104/12; 104/10

[58] Field of Search ..... 104/7 R, 7 B, 10, 12

[56] References Cited

U.S. PATENT DOCUMENTS

| | | | |
|---|---|---|---|
| 3,011,454 | 12/1961 | Plasser et al. | 104/12 |
| 3,534,687 | 10/1970 | Plasser et al. | 104/12 |
| 3,799,059 | 3/1974 | Sieke et al. | 104/12 |
| 4,066,020 | 1/1978 | Theurer | 104/7 B |
| 4,069,763 | 1/1978 | Theurer | 104/12 |
| 4,074,631 | 2/1978 | Theurer | 104/12 |

*Primary Examiner*—Randolph A. Reese
*Attorney, Agent, or Firm*—Kurt Kelman

[57] ABSTRACT

A vertically movable tamping head includes a pair of ballast tamping tool implements arranged for reciprocation in the direction of track elongation towards and away from each other. Each implement includes a rigid mounting support comprised of a vertically extending support arm in vertical alignment with a respective track rail and mounted for pivoting about an axis extending in the direction of the cross ties, a pair of wings extending transversely of the track symmetrically with respect to the support arm, and a tamping tool mounted on each wing. A single reciprocating drive pivots the support arms of the pair of tamping tool implements and the reciprocating drive is respectively connected to one of the support arms by means of a vibrating drive and linked directly to the other support arm.

9 Claims, 4 Drawing Figures

TRACK TAMPER

The present invention relates to improvements in a track tamper which comprises a frame arranged for mobility in an operating direction on a track consisting of a multiplicity of cross ties and two rails fastened to the cross ties, and a tamping head vertically movably mounted on the frame for vertical alignment with a respective one of the rails, the tamping head including a pair of ballast tamping tool implements arranged for reciprocation in the direction of track elongation towards and away from each other.

U.S. Pat No. 4,074,631, dated Feb. 21, 1978, discloses a tamping tool implement for use in such a tamping head, which includes a rigid mounting support comprised of a vertically extending support arm substantially in vertical alignment with the respective rail and mounted for pivoting about an axis extending in the direction of the cross ties, a pair of wings extending transversely of the track substantially symmetrically with respect to the support arm, and a tamping tool mounted on each of the wings and capable of tamping ballast under respective ones of the cross ties upon vertical movement of the tamping head and immersion of the tamping tools in the ballast adjacent the respective ties. A single reciprocating drive pivots the support arms of a pair of such implements forming a tamping head and a separate vibrating drive is connected to the implemenets for vibrating the tamping tools.

In the track tamper of U.S. Pat. No. 4,069,763, dated Jan. 24, 1978, a centrally mounted vibrating drive is mounted between the two tamping tool implements and respective reciprocating drives extend from the central vibrating drive towards the support arms of the implements and are linked thereto for reciprocating the pair of tamping tool implements. The implements themselves are constituted by the rigid units disclosed in U.S. Pat. No. 4,074,631.

These ballast tamping implements and the tamping heads incorporating them have been very successfully used in track surfacing operations. They are simple in construction and very robust. Furthermore, they transmit the reciprocating and vibratory forces from the drives to the ballast almost without loss.

In U.S. Pat. No. 3,799,059, dated Mar. 26, 1974, it has been suggested to use a reciprocatory drive for a pair of tamping tools which is operated by a pressure medium and which imparts vibrations to the tamping tools by superimposing a pulsating force on the pressure medium. Various operational difficulties have been encountered with this system, which includes flexible connecting lines, and it is, therefore, no longer widely used.

Recent developments in the railroad industry tend not only towards improvements in existing tracks to enhance their capability of sustaining high-speed and heavy-load traffic but also include extensive track renewal work, all of which has greatly increased the demand for efficient and versatile track tampers. In addition to technical requirements, simple economics play an ever expanding role since limited investment capital is available and railways look for lowered procurement and operating costs while insisting on ever greater operating efficiency, durability and versatility for railroad maintenance machinery.

To meet these demands, it is the object of this invention to provide a track tamper of the indicated type which is not only very simple and relatively inexpensive but also highly efficient and dependable in operation.

In a track tamper with tamping tool implements of the general type disclosed in U.S. Pat. Nos. 4,069,763 and 4,074,631, the above and other objects are accomplished in accordance with the invention by connecting a single reciprocating drive for pivoting the support arms of the pair of tamping tool implements to one of the support arms by means of a vibrating drive and linking the reciprocating drive directly to the other support arm. Preferably, the reciprocating drive is a hydraulic motor and the vibrating drive is an eccenter shaft drive which is advantageously mounted on the one support arm, the reciprocation drive begin linked to the vibrating drive in this preferred construction.

This arrangement does not only simplify the structure and correspondingly reduce the construction costs for the tamping head but also reduces its weight and its length in the longitudinal direction of the machine. In tamping machines wherein the tamping heads are mounted on a frame portion overhanging the front axle, this produces a uniform distribution of the weight over the axles and better visibility for the operator since the tamping heads can be positioned very close to the operator's cab. This facilitates the centering of the tamping tools with respect to the ties to be tamped, expediting the operation. Although the tamping head construction is simplified, the quality of tamping and its efficiency are excellent since the reciprocating and vibrating drives form a functional unit and equal reciprocating and vibrating forces are imparted to both tamping implements. In addition, the mounting and servicing of the tamping heads is also simplified.

The reduction of the machine weight facilitates the temporary removal of the track tamper from the track to permit trains to pass, thus enabling the machine to be used in track sections which carry relatively heavy traffic, thus further enhancing the usefulness of the track tamper of the present invention.

The above and other objects, advantages and features of this invention will become more apparent from the following detailed description of certain now preferred embodiments thereof, taken in conjunction with the accompanying schematic drawing wherein FIG. 1 is a side elevational view of one embodiment of the invention;

Figure 1:
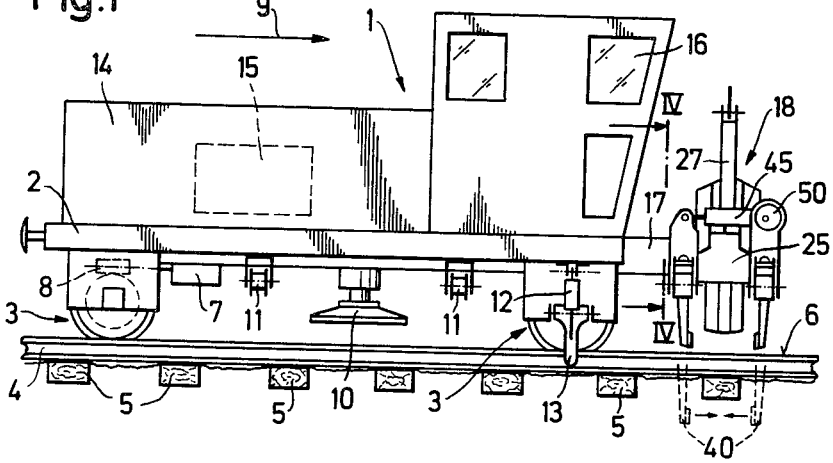
Figure 3:
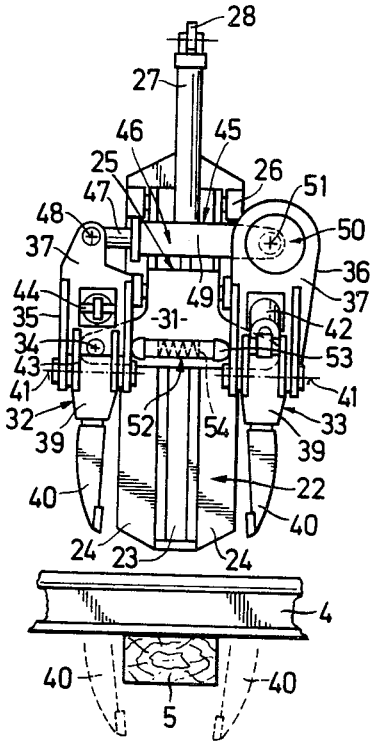
FIG. 3 is an enlarged side elevational view of the tamping head of FIG. 1.
Figure 4:
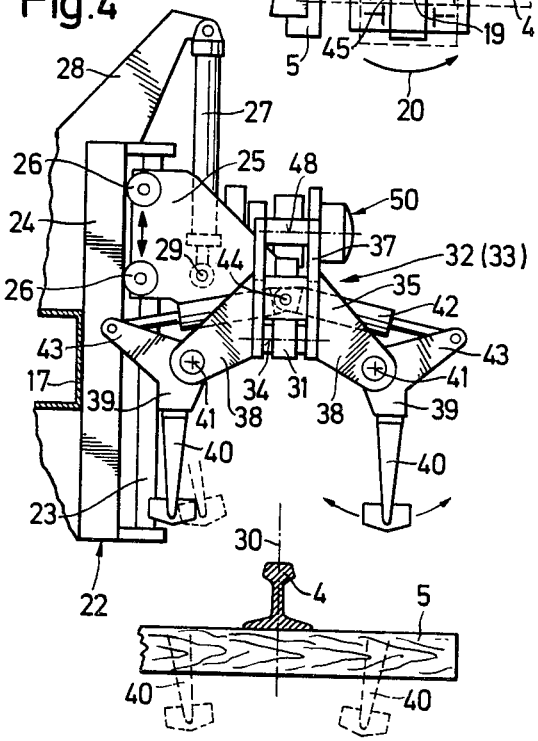
FIG. 4 is a similarly enlarged end view of the tamping head, as viewed in the direction of line IV—IV of FIG. 1.

Referring now to the drawing and first to FIGS. 1, 3 and 4, there is shown a mobile track tamper 1 comprising frame 2 arranged on track 6 consisting of a multiplicity of cross ties 5 and two rails 4 fastened to the cross ties for mobility in an operating direction indicated by arrow 9. Two single-axle undercarriages 3, 3 support frame 2 on track 6 and the tamper has its own drive comprising motor 7 and transmission 8 which, in the illustrated embodiment, connects the wheels of the rear undercarriage to the motor.

In the region of the point of gravity of machine frame 2, hydraulically operated lifting and turntable device 10 is mounted on the underside of the frame to enable the operating direction of the tamper to be reversed and the tamper to be removed to the side of the track to permit a train to pass. For the latter purpose, a pair of rollers 11, 11 is mounted symmetrically with respect to device 10 on each side of frame 2, the rollers being rotatable about axes extending in the direction of the track and the longitudinal extension of the machine frame. When it is desired to move the tamper temporarily off the track sideways, drive 10 is operated to lift the machine frame and a ramp is placed in position so that the rollers may run therealong to move the tamper to the side of the track.

A rail gripping hook 13 is mounted on frame 2 on each side thereof in the region of front undercarriage 3 and the hooks may be pivoted by hydraulic motor 12 to grip respective rail 4 and thus to provide a rigid connection between the front undercarriage and the rails, thus preventing the undercarriage from being lifted off the track rails during the tamping operation.

Machine frame 2 carries a box-like superstructure 14 housing the power plant 15 of the tamper and an operator's cab 16 having a large front window enabling the operator in the cab to view the tamping operation.

Central girder 17 projects forwardly of front undercarriage 3 from machine frame 2 and carries two symmetrically arranged vertically movable tamping heads 18 for vertical alignment with a respective rail 4, thus enabling ties 5 to be tamped at their points of intersection with rails 4. Since the two tamping heads are laterally aligned, only one tamping head can be seen in the side view of FIG. 1. It is within the scope of the invention to provide only a single tamping head for tamping at a selected rail and to mount this tamping head on a cross beam affixed to girder 17 for lateral movement between rails 4. With such a modification, the tamping head is first aligned with one rail to tamp the cross tie at the intersection with this rail and is then laterally moved into vertical alignment with the other rail to repeat the tamping operation there.

Figure 2:
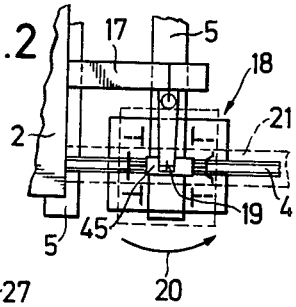
FIG. 2 is a partial, diagrammatic top view of another embodiment, showing one tamping head.

In the modified embodiment of FIG. 2, tamping head 18 is mounted on girder 17 not only vertically movably but also for pivoting about vertical axis 19 through an arc of at least 90°. The vertical pivoting axis extends in the plane of symmetry of rail 4 so that tamping head 18 may be turned from the operating position shown in full lines for tamping ballast under cross ties 5 to the operating position shown in broken lines for tamping ballast under longitudinally extending ties 21, such as found in streetcar tracks. In this modification, too, the tamper may be equipped with two tamping heads associated with the respective rails or a single tamping head selectively positionable in vertical alignment with a respective rail by transverse movement from one rail to the other.

FIGS. 3 and 4 illustrate tamping head 18 of FIG. 1 in detail. As shown, guide structure 22 is affixed to the forwardly projecting girder 17 and the guide structure comprises vertical guide column 23 and a pair of vertical guide tracks 24 arranged symmetrically with respect to the guide column on either side thereof. Tamping tool carrier 25 has four guide rollers 26 and the carrier is mounted for vertical gliding movement on guide column 23, a respective pair of the guide rollers engaging a respective guide track 24. Hydraulic jack 27 has one end linked to upwardly projecting arm 28 mounted on girder 17 and an opposite end linked to bearing bolt 29 mounted on the tamping tool carrier and extending in the longitudinal direction of the machine, i.e. the track direction. Operation of hydraulic jack 27 servies to lower and raise the tamping head between a rest position shown in full lines in FIG. 4. and a tamping position indicated by broken lines only with respect to tamping tools 40, wherein tamping tools are immersed in the ballast adjacent the respective ties.

Tamping tool carrier 25 comprises support plate 31 extending substantially in vertical plane of symmetry 30 of rail 4 with which the tamping head is associated and a pair of ballast tamping tool implements 32, 33 is arranged on the support plate for reciprocation in the direction of track elongation towards and away from each other. Each tamping tool implement 32 (33) includes rigid mounting support 35 (36) comprised of vertically extending support arm 37 substantially in vertical alignment with respective rail 4 and mounted for pivoting about axis 34 extending in the direction of cross ties 5, and a pair of wings 38 extending transversely of the track substantially symmetrically with respect to support arm 37. The rigid mounting support unit further includes holder 39 mounted on each wing 38 and tamping tool 40 replaceably mounted in each holder and capable of tamping ballast under respective ones of cross ties 5 upon vertical movement of the tamping head and immersion of the tamping tools in the ballast adjacent the respective ties. Tamping tool holders 39, with their tamping tools, are mounted on the wings for pivoting about axes 41 extending substantially parallel to rails 4 and drive means 42 are arranged for independently pivoting each of the tamping tool holders. This independent adjustment of the tamping tools on each implement makes it possible to use the available space for a particularly compact arrangement of the support and drive for the pivotal tamping tools and further to reduce the width of the tamping head. Each drive means 42 is illustrated as a hydraulic motor having one end linked to driving arm 43 of holder 39, which has the shape of a bellcrank lever, and an opposite end linked to centeral anchoring bolt 44 of the mounting support. To make the showing in FIG. 3 clearer, hydraulic motor 42 has not been shown for tamping tool implement 32.

As shown, a single reciprocating drive 45 pivots the support arms of the pair of tamping tool implements 32, 33. The illustrated reciprocating drive consists of hydraulic motor 46 comprised of cylinder 49 extending substantially parallel to rails 4 and piston rod 47, an end of the piston rod being linked to support arm 37 of tamping tool implement 32 at pivot 48 extending in the direction of the cross ties while an end of the cylinder is linked to vibrating drive 50 mounted on the support arm of tamping tool implement 33. FIG. 3 illustrates eccenter shaft 51 of the vibrating drive symbolically as the theoretically eccentric connecting point of cylinder 49 of hydraulic motor 46 to the vibrating drive.

In the illustrated preferred embodiment, guide mechanism 52 is arranged for operation in association with single reciprocating drive 45 for maintaining reciprocatory tamping tool implements 32, 33 in respective positions substantially symmetrical with respect to respective cross ties 5, particularly in their spread end positions. This arrangement assures that the tamping tools return automatically and promptly into their spread end positions immediately after completion of each tamping movement, thus placing the tamping tools into their fully spread positions before the succeeding tamping movement and greatly facilitating the centering of the tamping tools with respect to each tie to be tamped. The illustrated guide mechanism comprises a pair of spring-biased abutments 53, such as rubber bumpers, mounted on carrier 25 and pressing against mounting supports 35 and 36 of the tamping tool implements. The guide mechanism is mounted on support plate 31 between the tamping tool implements and coil spring 54 is arranged between the two abutments to bias them against support arms 37. Obviously, various functionally equivalent structures may be devised for guide mechanism 52 and the spring may be replaced, for example, by a pneumatic pressure means.

Since both tamping tool implements 32, 33 receive substantially the same reciprocating and vibrating force from drives 45 and 50, tamping head 18 operated substantially in the same manner as like tamping heads with separate reciprocating drives for the pair of tamping tool implements. In operation, the tamping tools of the tamping head are centered with respect of a cross tie 5 to be tamped, jack 27 is operated to lower the tamping head until the tamping tools are immersed in the ballast in the position shown in broken lines in FIGS. 1, 3 and 4, and drives 45 and 50 are actuated to reciprocate the vibrating tamping tools in the direction of the cross ties lying therebetween to tamp ballast under the tie (see facing arrow in FIG. 1 between tamping tools 40). The tamping is completed as soon as the desired pressure built up in the hydraulic supply system connected to reciprocating drive 45 has been reached and sensed, which pressure corresponds to the desired density of the tamped ballast.

In view of the individual adjustability of tamping tools 40 on the tamping tool implements, tamping heads 18 may be effectively used not only in regular track sections but also in switches and crossings. If tamper 1 is to be used primarily for regular track work, it will be useful to equip it with two tamping heads. For use in branch tracks, a tamper with a single, laterally displaceable tamping head may be more economical. If the tamping head is pivotal about a vertical axis, as in the embodiment of FIG. 2, it can also be used for tamping longitudinally extending ties found in some forms of special tracks or in streetcar tracks, or for tamping the end regions of cross ties outside the rails.

What is claimed is:

1. A track tamper comprising a frame arranged on a track consisting of a multiplicity of cross ties and two rails fastened to the cross ties, and a tamping head vertically movably mounted on the frame for vertical alignment with a respective one of the rails, the tamping head including (a) a pair of ballast tamping tool implements arranged for reciprocation in the direction of track elongation towards and away from each other, each of the implements including (1) a rigid mounting support comprised of a vertically extending support arm substantially in vertical alignment with the respective rail and mounted for pivoting about an axis extending in the direction of the cross ties, (2) a pair of wings extending transversely of the track substantially symmetrically with respect to the support arm, and (3) a tamping tool mounted on each of the wings and capable of tamping ballast under respective ones of the cross ties upon vertical movement of the tamping head and immersion of the tamping tools in the ballast adjacent the respective ties, (b) a single reciprocating drive for pivoting the support arms of the pair of tamping tool implements, and (c) a vibrating drive, (1) the reciprocating drive being respectively connected to one of the support arms by means of the vibrating drive and being linked directly to the other support arm.

2. The track tamper of claim 1, wherein the reciprocating drive is a hydraulic motor and the vibrating drive is an eccenter shaft drive.

3. The track tamper of claim 1, wherein the vibrating drive is mounted on the one support arm and the reciprocating drive is linked to the vibrating drive.

4. The track tamper of claim 3, wherein the frame is arranged for mobility on the track in an operating direction, and the one support arm is the support arm of the tamping tool implement leading in the operating direction.

5. The track tamper of claim 4, wherein the reciprocating drive consists of a cylinder extending substantially parallel to the rails and a piston rod, and the vibrating drive is an eccenter shaft drive, the cylinder being linked to the eccenter shaft and the piston rod being linked to the other support arm of the tamping tool implement trailing in the operating direction.

6. The track tamper of claim 1, wherein the tamping tools are mounted on the wings for pivoting about an axis extending substantially parallel to the rails, and further comprising drive means arranged for pivoting the tamping tools.

7. The track tamper of claim 1, further comprising a guide mechanism arranged for operation in association with the single reciprocating drive for maintaining the reciprocatory tamping tool implements in respective positions substantially symmetrical with respect to the respective ties.

8. The track tamper of claim 7, wherein the tamping head further comprises a carrier for the tamping tool implements, and the guide mechanism comprises a pair of spring-biased abutments mounted on the carrier and pressing against the mounting supports of the tamping tool implements.

9. The track tamper of claim 1, wherein the tamping head is mounted on the frame for pivoting about a vertical axis through an arc of at least about 90°.

* * * * *